United States Patent [19]

Stokes

[11] Patent Number: 4,664,260

[45] Date of Patent: May 12, 1987

[54] CONTAINER/PALLET FOR ANNULAR PACKAGES OF STRAND MATERIAL

[75] Inventor: William H. Stokes, Fostoria, Ohio

[73] Assignee: Seneca Wire and Manufacturing Company, Fostoria, Ohio

[21] Appl. No.: 851,337

[22] Filed: Apr. 14, 1986

[51] Int. Cl.[4] ..... B65D 21/02; B65D 85/04

[52] U.S. Cl. ..... 206/386; 206/303; 206/397; 206/408; 206/509; 206/499; 242/129; 108/53.1

[58] Field of Search ..... 206/303, 397, 408, 493, 206/499, 509, 386; 108/53.1, 53.3, 52.1, 55.3, 141, 137; 242/129

[56] References Cited

U.S. PATENT DOCUMENTS

| | | | |
|---|---|---|---|
| 1,897,598 | 10/1930 | Wyman, Jr. | 206/303 |
| 2,031,851 | 2/1936 | Plunkett | 206/408 |
| 2,543,619 | 2/1951 | Amberg | 206/509 |
| 2,916,152 | 3/1955 | Dull | 211/49.1 |
| 3,021,010 | 6/1960 | McMasters | 211/49.1 |
| 3,127,018 | 12/1963 | McMasters | 211/59.1 |
| 3,541,977 | 11/1970 | Waldman | 108/53.1 |
| 3,552,548 | 1/1971 | Wallestad | 220/4 D |
| 3,719,272 | 3/1973 | Bodine et al. | 206/328 |
| 3,719,273 | 3/1973 | Abe | 206/328 |
| 3,722,825 | 3/1973 | Phillips et al. | 242/129 |
| 3,819,847 | 6/1974 | Charles | 206/499 |
| 3,853,223 | 12/1974 | Nowlain | 206/403 |
| 3,917,108 | 11/1975 | Thurman | 220/66 |
| 3,961,707 | 6/1976 | Lehr et al. | 206/419 |
| 4,068,971 | 1/1978 | McNeill | 294/67.1 |
| 4,085,847 | 4/1978 | Jacalone | 206/600 |
| 4,257,523 | 3/1981 | Blasio | 206/303 |
| 4,602,752 | 7/1986 | Nimke et al. | 242/129 |

*Primary Examiner*—William Price
*Assistant Examiner*—Brenda J. Ehrhardt
*Attorney, Agent, or Firm*—Dann, Dorfman, Herrell & Skillman

[57] ABSTRACT

A container device for transporting and storing coils of wire which protect the coils from damage. The device comprises a circumferential shell having a recessed annular bottom element inwardly adjacent the upper edge of the shell to form an open-topped annular receptacle in the upper side of the device. The inner edge of the bottom element extends upwardly to provide a hollow central post concentric with the outer shell. The underside of the device is formed with a closure wall coextensive in width with the recessed bottom element and is adapted to form a closure for the open-topped receptacle of the subjacent container device when the devices are stacked one upon another. Sockets for a forklift truck are provided in the circumference of the shell to enable the forklift truck to manipulate the devices into and out of position in the stack.

10 Claims, 3 Drawing Figures

CONTAINER/PALLET FOR ANNULAR PACKAGES OF STRAND MATERIAL

FIELD OF THE INvENTION

The present invention relates to a container or pallet device used for storing and transporting packaged material and has particular application to the transportation and storage of wire in coiled form.

BACKGROUND OF THE INVENTION

Wire is conventionally supplied to manufacturing operations in the form of coiled packages which are designed to be mounted on spools adjacent the feed end of the forming machine which may be a machine for making springs, or a wire drawing machine for reducing the diameter of the wire for use in subsequent operations. When the wire forming machine is run continuously, the conventional method of handling wire is satisfactory since a full spool is mounted on a reel adjacent the machine and the machine continues to operate until the wire is exhausted from the reel. However, when running the machine in short runs, problems may develop when it is necessary to change the wire supply, for example when changing from one size of spring wire to another, or when changing from wire of one material to another. When changing the wire, the coil of wire on the spool must be tied or otherwise secured so that the run of wire extending into the machine may be severed to enable removal of the coil, which may then be of a non-standard size or configuration. The removal of the non-standard coil presents difficulty and sometimes the coil may be damaged by the handling equipment, or may be damaged during storage between runs. If the remaining coil is not properly tied, the wire may spring out of its coiled configuration and be lost for further use.

In any event the storage facilities for the wire prior to its being installed adjacent the wire receiving machinery, normally is in a yard area where the wire is exposed to the weather. In shipping the wire coils, they are also exposed to the weather. If the wire is stored under roof, it normally is in a remote section of the plant where the wire may become corroded or otherwise impaired by exposure to the ambient conditions.

SUMMARY OF THE INYENTION

The present invention provides a container or pallet device which may receive coils of wire and which may be installed with the wire on the payoff reel at the feed end of the wire-receiving machine in a fashion so that the wire is paid out from the device without need for separate handling of the wire coil.

More specifically, the present invention provides a device for receiving a coil of wire or other strand material which enables the dispensing of the strand material from the coil without removal of the material from the container device, and which facilitates the tying of the strand material in the container device for example at the end of a short run, when it is desired to remove the coil from the strand-receiving machine.

The present invention provides a container/pallet for the coil of wire which enables the coil to be handled by conventional material-handling equipment, regardless of the amount of wire which has been dispensed from the coil and regardless of the amount of wire remaining in the coil.

The present invention also provides a container/pallet for wire for packaged material which not only permits the dispensing of the material from the package while in the container while it is open, but also permits enclosure of the packaged material within a closed compartment for example during storage and/or shipment. Specifically, the device of the present invention permits stacking of the container devices so that mounting of one device on another effects a closure of the storage compartment of the subjacent device by the suprajacent device.

All of the objects of the invention are more fully set forth hereinafter with reference to the accompanying drawing wherein:

Figure 1:
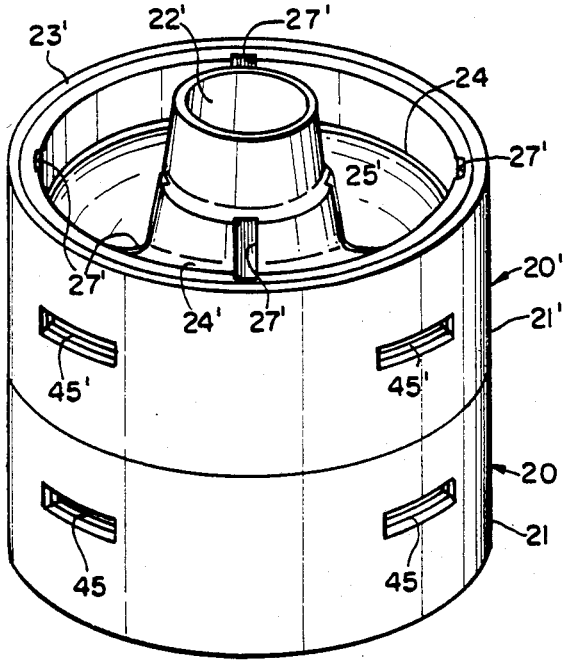
FIG. 1 is a perspective view showing a pair of stacked container or pallet devices for receiving packaged material with the packaged material removed therefrom.

Referring to the drawing, and more particularly to FIG. 1, two devices are shown in stacked relation. In the following description, the parts of the devices are designated with the same reference numerals, but the reference numerals for the upper device are primed so as to clarify the description of the devices where they are interrelated in the stack. The lower device will be described in detail and this description is equally applicable to the upper device without repeating.

The container/pallet device is identified generally by the reference numeral 20 and is a generally annular structure having an outer upright shell 21, and an interior upstanding post 22, which in the present instances projects above the level of the top of the shell 21. The top of the shell 21 forms a rim 23, which, as described more fully hereinafter, forms an upwardly-facing bearing surface. Between the rim 23 and the post 22 a recessed bottom 24 extends in an upwardly convex configuration to provide an open-topped receptacle or storage space on the upper surface of the annular structure 20.

Figure 2:
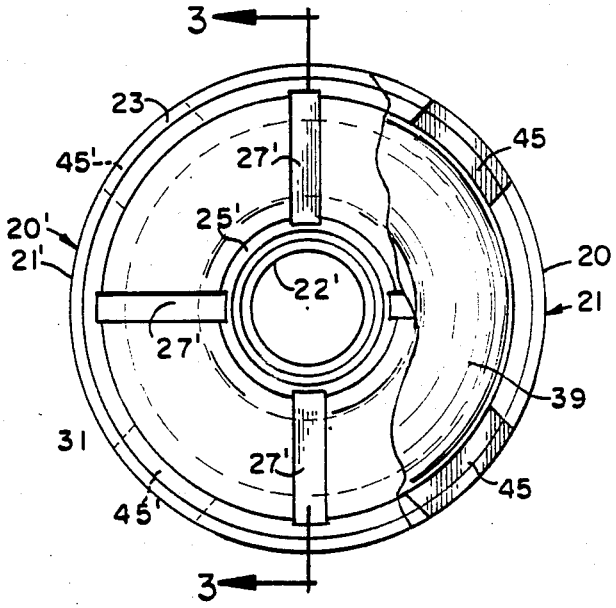
FIG. 2 is a plan view of a device shown in FIG. 1 with the upwardly facing wall of the device being broken away to more clearly illustrate its construction and arrangement.
Figure 3:
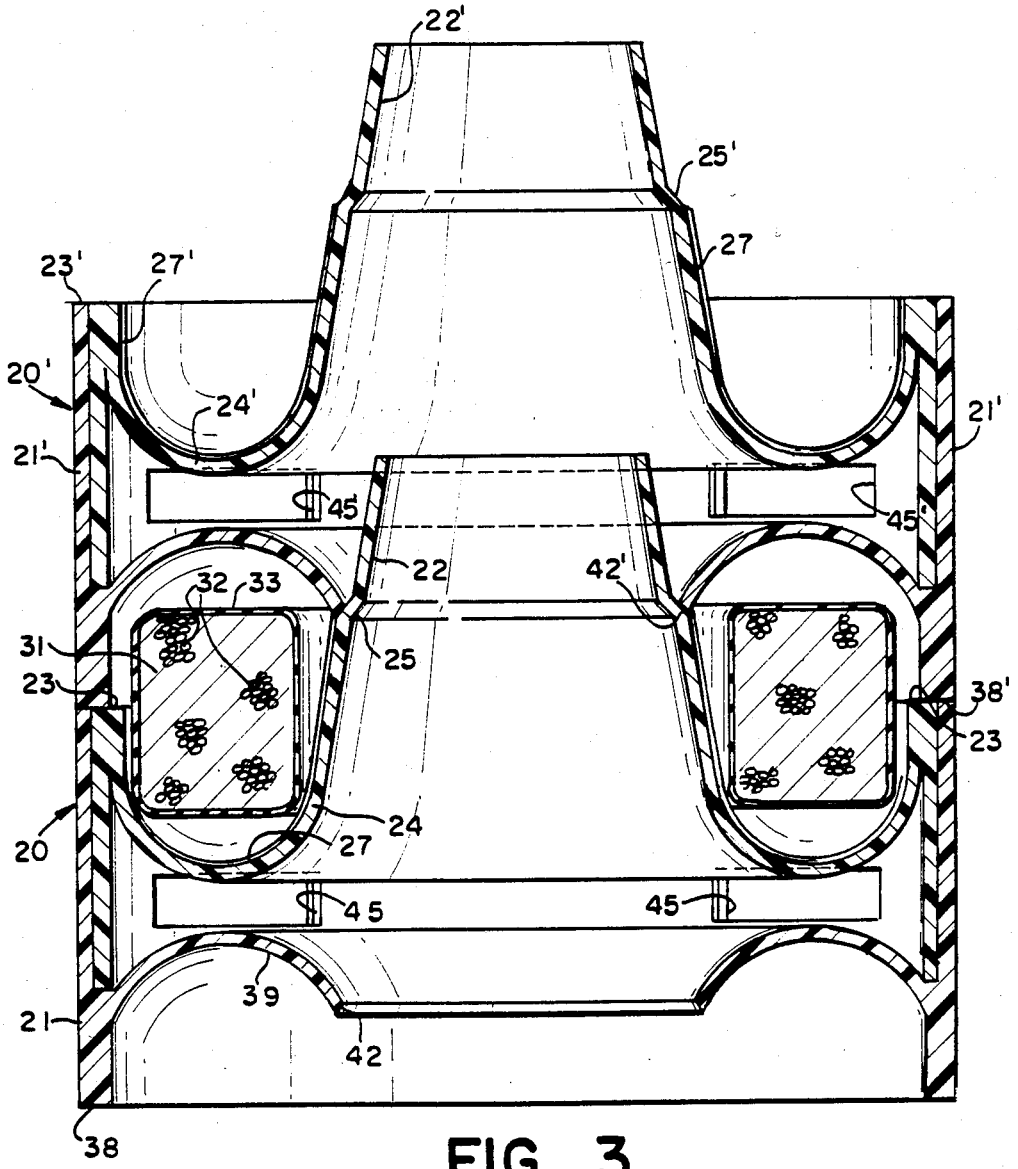
FIG. 3 is a transverse sectional view taken on the line 3—3 of FIG. 2 and showing packaged material enclosed in the lower container or pallet device of the stack.

In the present instance, the recessed bottom 24 has a generally semi-circular cross section starting adjacent the rim 23 and extending downwardly and then upwardly to merge with the post 22 in an offset shoulder area 25 which is positioned above the level of the rim 23 as shown in FIG. 3. As seen from above, as in FIG. 2, the receptacle formed by the bottom component 24 is bottom component 24 is generally circular in outline and is adapted to receive a coil of wire illustrated at 31 in FIG. 3. The coil 31 in the present instance is circular in outline having an open core about which the individual convolutions of the wire strand 32 are wound. To maintain the integrity of the coil, straps 33 are wound about the convolutions at spaced intervals about the circumference of the coil, in the present instance at four locations spaced apart 90° about the circumference. The tie straps 33 are adapted to be released to permit the strand of the wire to be paid out from the coil during use. To prevent the wire from uncontrolled springing out of the receptacle, the free end of the wire is engaged in the machine before the last tie strap is released. The thickness of the multiple convolutions in the coil is less than the spacing between the rim 23 and the post 22 of the device 20 so that the coil may be enclosed within the receptacle formed by the recessed bottom 24.

In order to enable the strand of wire to be paid out from the coil 31 while in the receptacle provided by the bottom 24, the tie elements 33 are removed from the coil and the free end of the coil may be withdrawn from the coil through the open top of the receptacle and engaged in the wire-handling machine. When used in conjunction with a conventional wire-handling machine, the pallet device 20 device may be mounted on the rotary spool which is positioned adjacent the feed end of the conventional wire-handling machine, and as the wire is drawn from the coil 31 the spool may rotate to permit the wire to feed into the wire-handling machine without kinks or other disruptions. When it is desired to terminate the feed of the wire into the machine, it is desirable to maintain the wire tensioned in the machinery and tie up the remaining part of the coil before the tension is removed from the wire so that the wire does not uncontrollably spring out from the coil. To facilitate the re-tying of the partially used coil, the bottom element 24 is provided with transverse grooves 27 which are formed in the bottom and extend from the rim 23 to the post 22. The grooves 27 are shown in FIGS. 1 and 2 and are constructed and arranged so that a tie element such as a metal strap or tie wire may be threaded through each groove 27 to encircle the wire strands remaining in the coil 31 within the receptacle formed by the bottom wall 24. After threading through the grooves 27, the tie elements are secured together to maintain the strands compactly wound in coil form, after which the free end of the strands may be severed from the wire-handling machine to permit removal of the pallet element 20 with the remaining portion of the wire coil 33 securely in place within its receptacle. The smooth curvature of the bottom wall 24 is effective to facilitate the threading of the tying elements in the groove between the bottom of the groove and the strands in the coil which bears against the bottom wall 24 between the grooves 27.

The lower edge of the upright shell 21 forming the circumferential wall of the pallet device 20 forms a downwardly facing support surface 38 which may be rest on the floor of the storage space when the device is stored, may rest upon the bed of a transport vehicle when the device is transported, or may rest on the lower flange of the spindle when the device is mounted adjacent the wire-handling machine. The configuration of the downwardly-facing support surface 38 is constructed to bear against the upwardly-facing bearing surface provided by the rim 23 when the pallet devices 20 are stacked as shown in FIGS. 1 and 3. Specifically, the surface 38' of the upper pallet in FIG. 3 bears against the bearing surface 23 of the lower pallet. Preferably the upwardly facing surface 23 and the downwardly facing surface 38' are continuous about the entire periphery of the pallet device 20 so as to distribute the support load of the pallet device about the entire circumference of the subjacent pallet device.

Projecting inwardly from the support surface 38, an arcuate closure wall 39 extends inwardly and terminates in a central opening 42 which is adapted to correspond to and register with the upwardly-facing surface of the shoulder 25. As shown in FIG. 3, the marginal portion of the opening 42' of the upper pallet bears against the surface 25 of the lower pallet so as to provide proper nesting of the upper pallet upon the lower pallet. To this end the upstanding post 22 is tapered upwardly so that the tapered surface of the post 22 may engage within the opening 42' of the upper pallet as the pallet is lowered into the superimposed position on the lower pallet as shown in FIG. 3. When positioned as shown, the closure wall 39 in combination with the lower part of the shell 21 and the support surface 38 form a closure for the receptacle formed by the bottom 24. Thus as shown in FIG. 3, when the pallet devices 20 are stacked one on top of another as shown, the coil 31 which is supported by the lower pallet 20 is completely enclosed by the cover wall 39 of the upwardly adjacent pallet 20'. Enclosing the coil in this fashion protects it against the weather, if it is stored outside, or against dirt or damage during handling within a warehouse or other storage facility. When the container/pallet devices are stacked, the coil within the receptacle is also protected from damage during transport. The arcuate cross sections of the bottom 24 and the closure wall 39 cooperate to define a toroidal cavity for receiving the coil 30.

As shown in FIG. 3, the lower surface of the bottom wall 24 and the upper surface of the cover wall 39 are spaced apart vertically within the center of the pallet 20. This spacing is dimensioned to accommodate lift forks of a conventional forklift truck so that the individual pallet devices or the stack of devices, may be transported or manipulated by a standard forklift truck. To afford entry of the forks into the space between the walls 24 and 39, the shell of the pallet 20 is provided with socket openings 45 at spaced locations about the circumference about the pallet shell 21. In the present instance there are four sockets 45 spaced at 90° locations about the circumference. The projected width of the socket as seen by the forklift truck, is greater than the width of the individual forks of the truck so that the forks may enter through the sockets 45 and engage under the bottom of the bottom wall 24. It is noted that in the drawing, the upper edge of the sockets is slightly above the bottom surface of the bottom wall 24 so as to ensure engagement of the upper surface of the forks with the undersurface of the wall 24 to thereby provide an application of the weight of the loaded pallet directly upon this central part of the fork through the bottom wall 24 rather than concentrating the lifting force on the marginal part of the shell surrounding the sockets 45. The particular arrangements of the sockets 45 permits the forklift truck to approach the stacked pallet device from any one of four positions about the circumference thereby facilitating the handling of the pallets by the forklift truck.

It should be noted that the illustrated embodiment of the invention employs thin wall sections throughout which greatly reduces the weight of the pallet device 20 without sacrificing substantial structural stength which results from the circular outline of the pallet device. The illustrated pallet device is formed from two pieces molded from a strong and durable resinous material, either natural or synthetic, either homogeneous or with reinforcing elements incorporated therein. As shown, the two parts are telescopically engaged so that the shell 21 comprises an inner layer which is molded integrally with the bottom wall 24 and post 22 and an outer layer which is molded integrally with the cover wall 39. The two parts may be molded separately and then telescopically engaged as shown and may be integrated by heat, cement, or by a mechanical bond, which may be accomplished when forming the sockets 45 through the multiple layers of the shell 21. During the molding operation, reinforcement may be incorporated in the components to strengthen those parts of the pallet device which are subject to greatest load.

While a particular embodiment has been illustrated and described, it will be evident that changes and modifications may be made therein and thereto within the scope of the following claims.

I claim:

1. A container/pallet device for receiving an annular package of material for supporting the same during transportation and storage, said device comprising a circumferential upright hollow shell having a base portion at its lower edge adapted to provide a supporting surface for said device, the upper end of the shell terminating in a circumferential rim extending continuously about the complete circumference of said shell; an upstanding post disposed centrally within the hollow of said shell generally concentric with said rim and extending upwardly beyond the level of said rim; an upper wall forming a recessed bottom extending between said rim and said post, said rim, said upper wall, and said post cooperating to define an annular, open-topped annular receptacle between said rim and said post for receiving said annular package, said annular package having given inner and outer dimensions, the width of said post being less than the inner dimension of said package so that the post may project upwardly through the inside of said package, the outer dimension of said annular receptacle adjacent said rim being greater than the outer dimension of the package so that the package may rest on the recessed bottom within said receptacle; said device including a lower closure wall extending from said hollow shell a predetermined distance below said rim inwardly from said base a distance corresponding to the extension of said recessed bottom and terminating in a central opening corresponding to the width of the post, so that when said device is stacked upon a similar device, said closure wall extends from the rim to the post of the similar device to form a closure for the open-topped receptacle of said similar device.

2. A device according to claim 1 wherein said rim, said recessed bottom and said closure wall are continuous about the entire circumference of said device so that when the devices are stacked, the receptacle is closed.

3. A device according to 1 wherein said annular package comprises a circular coil of strand material, and said shell, rim and post have circular outlines.

4. A device according to claim 1 wherein said shell comprises an inner layer and an outer layer, said layers being telescopically engaged, the one of said layers being integral with said recessed bottom and the other of said layers being integral with said closure wall.

5. A device according to 1 wherein said recessed bottom and closure wall generally arcuate in cross section so as to define between them a toroidal cavity in which the annular package may be positioned.

6. A device according to claim 1 wherein said post has an outward offset adjacent said recessed bottom forming an upwardly facing circumferential shoulder thereabout, and said bottom closure wall terminates centrally in an opening, the marginal edge of which is constructed and arranged to register with and bear upon said upwardly facing shoulder when said devices are stacked.

7. A device according to claim 6 wherein said central post is tapered upwardly so as to serve as a centering guide for said opening as said pallets are stacked one upon another.

8. A device according to claim 1 wherein said annular package of material comprises a coil of strand material having tie components extending in a loop around the coil transversely to the strands of said strand material to maintain said strands in a compact winding, said recessed bottom having a plurality of grooves disposed transversely between said post and said rim, said grooves having a cross section greater than the cross section of tie straps used to encircle the package of material.

9. A container/pallet device for receiving an annular package of material and for supporting the same during transportation and storage, said device comprising a circumferential upright shell having a base portion at its lower edge adapted to provide a supporting surface for said device, the upper end of the shell terminating in a circumference rim extending continuously about the complete circumference of said shell; an upstanding post disposed centrally of said shell generally concentric with said rim and extending upwardly beyond the level of said rim; a recessed bottom extending between said rim and said post, said rim, said recessed bottom, and said post cooperating to define an annular, open-topped receptacle between said rim and said post for receiving said annular package, said annular package having given inner and outer dimensions, the width of said post being less than the inner dimension of said package so that the post may project upwardly through the inside of said package, the outer dimension of said annular receptacle adjacent said rim being greater than the outer dimension of the package so that the package may rest on the recessed bottom within said receptacle; said device including a closure wall extending inwardly from said base a distance corresponding to the extension of said recessed bottom and terminating in a central opening corresponding to the width of the post, so that when said device is stacked upon a similar device, said closure wall extends from the rim to the post of the similar device to form a closure for the open-topped receptacle of said similar device; and sockets in said upright shell positioned about the circumference of the shell at spaced intervals, said device being adapted for use with a forklift truck having a pair of forks spaced apart a given distance, the spaced intervals between said sockets corresponding to the given distance of spacing between said forks whereby said forks may be engaged in said sockets to enable manipulation and transportation of said device by said forks independently of said supporting surface at the base portion of said shell.

10. A device according to claim 9 wherein said closure wall is below said recessed bottom whereby said device is hoillow between said recessed bottom and said closure wall, and said sockets in the shell communicate with said hollow interior at the level between said recessed bottom and said closure wall.

* * * * *

UNITED STATES PATENT AND TRADEMARK OFFICE

CERTIFICATE OF CORRECTION

PATENT NO. : 4,664,260

DATED : May 12, 1987

INVENTOR(S) : William H. Stokes

It is certified that error appears in the above-identified patent and that said Letters Patent is hereby corrected as shown below:

Column 1, line 5, "INvENTION" should be --INVENTION--;

Column 1, the substitle "Summary of the Inyention" should read --Summary of the Invention--;

Column 2, line 56, delete "bottom component 24 is";

Column 3, line 13, delete "device" (second occurrence);

line 46, after "may" delete "be";

Column 4, line 56, "stength" should be --strength--;

Column 6, line 59, "hoillow" should be --hollow--.

Signed and Sealed this

Twenty-seventh Day of October, 1987

*Attest:*

DONALD J. QUIGG

*Attesting Officer*

*Commissioner of Patents and Trademarks*